US008297083B2

(12) United States Patent
Kim et al.

(10) Patent No.: US 8,297,083 B2
(45) **Date of Patent: *Oct. 30, 2012**

(54) WASHING MACHINE HAVING BALL BALANCERS

(75) Inventors: Ja Young Kim, Suwon-si (KR); Doo Young Ryu, Suwon-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 616 days.

This patent is subject to a terminal disclaimer.

(21) Appl. No.: 11/898,054

(22) Filed: Sep. 7, 2007

(65) Prior Publication Data

US 2008/0110212 A1 May 15, 2008

(30) Foreign Application Priority Data

Nov. 10, 2006 (KR) ..... 10-2006-00111278

(51) Int. Cl.
*D06F 35/00* (2006.01)
*D06F 37/04* (2006.01)
*D06F 37/26* (2006.01)

(52) U.S. Cl. ..... 68/23.2; 68/23.1; 68/212; 210/144; 74/570.2

(58) Field of Classification Search ..... 68/23.2, 68/212, 23.1; 210/144; 74/570.2
See application file for complete search history.

(56) References Cited

U.S. PATENT DOCUMENTS 2,984,094 A * 5/1961 Belaieff ..... 68/23.2
5,850,748 A * 12/1998 Kim et al. ..... 68/23.2
5,850,749 A * 12/1998 Kim ..... 68/23.2
5,857,360 A 1/1999 Kim et al.
5,862,553 A 1/1999 Haberl et al.
5,916,274 A 6/1999 Lee et al.
6,082,151 A * 7/2000 Wierzba et al. ..... 68/23.2
6,119,547 A 9/2000 Goransson et al.

(Continued)

FOREIGN PATENT DOCUMENTS

CN 1169483 1/1998

(Continued)

OTHER PUBLICATIONS

Chinese Office Action issued in Chinese Patent Application No. 200710148784.2 on Jun. 5, 2009.

(Continued)

*Primary Examiner* — Michael Kornakov
*Assistant Examiner* — Katelyn Whatley
(74) *Attorney, Agent, or Firm* — Staas & Halsey LLP

(57) ABSTRACT

Disclosed is a washing machine having ball balancers, which adjust a relation between a gap, between the inner wall of a racer of each of the ball balancers and balls, and viscous oil, so as to reduce the vibration and noise of the washing machine. Each of the ball balancers of the washing machine includes balls and viscous oil accommodated in a racer, and the viscosity of the viscous oil is varied in proportion to a gap between the racer and the balls. When the viscosity of the viscous oil is 1~100 cSt, the gap is set to 0.5~1.0 mm, when the viscosity of the viscous oil is 100~380 cSt, the gap is set to 1.0~2.0 mm, and when the viscosity of the viscous oil is 380~1,000 cSt, the gap is set to 2.0~3.0 mm. Thereby, the relation between the gap and the viscous oil is optimized, and the ball balancers effectively exhibit a balancing function and thus minimize the vibration and noise of the washing machine.

6 Claims, 10 Drawing Sheets

U.S. PATENT DOCUMENTS

| | | | | |
|---|---|---|---|---|
| RE37,530 | E | 1/2002 | Garstecki et al. | |
| 6,442,782 | B1 | 9/2002 | Vande Haar | |
| 6,658,902 | B2 * | 12/2003 | Southworth et al. | 68/23.2 |
| 2002/0016997 | A1 | 2/2002 | Jonsson | |
| 2003/0110814 | A1 | 6/2003 | Southworth et al. | |
| 2007/0277560 | A1 * | 12/2007 | Kim et al. | 68/23.1 |

FOREIGN PATENT DOCUMENTS

| | | | |
|---|---|---|---|
| DE | 198 49 594 | | 10/1998 |
| DE | 19849594 | C1 * | 3/2000 |
| JP | 10-043474 | | 2/1998 |
| KR | 10-1999-0038279 | | 6/1999 |

OTHER PUBLICATIONS

Korean Office Action issued Jan. 20, 2010 in corresponding Korean Patent Application 10-2006-0111278.

U.S. Office Action dated Oct. 26, 2011, issued in the file history of U.S. Appl. No. 13/064,972.

U.S. Office Action dated Jul. 20, 2011, issued in the file history of U.S. Appl. No. 13/064,972.

U.S. Office Action dated Apr. 4, 2012, issued in the file history of U.S. Appl. No. 13/064,972.

U.S. Notice of Allowance dated Jul. 3, 2012, issued in the file history of U.S. Appl. No. 13/064,972.

* cited by examiner

WASHING MACHINE HAVING BALL BALANCERS

CROSS-REFERENCE TO RELATED APPLICATIONS

This application claims the priority benefit of Korean Patent Application No. 2006-0111278, filed Nov. 10, 2006, in the Korean Intellectual Property Office, the disclosure of which is incorporated herein by reference.

BACKGROUND

1. Field

Embodiments relate to a ball balancer of a washing machine, and more particularly, to a relation between a gap, between a racer and balls, and viscous oil of a ball balancer of a washing machine.

2. Description of the Related Art

Generally, washing machines wash laundry by rotating a drum containing the laundry using a driving motor. The drum is rotated at a low speed in regular and opposite directions during a washing process, and is rotated at a high speed in a regular direction during a dehydrating (drying) process.

During the dehydrating (drying) process, the drum is rotated at a high speed under the condition that laundry is not equally disposed in all regions of the drum and is crowded at a specific region of the drum, or the laundry is pushed to one side of the drum due to the accelerated rotation of the drum at an initial state of the dehydrating (drying) process. As a result, the center of gravity of the drum does not coincide with the center of rotation of the drum, thus generating vibration and noise. When the above phenomenon is repeated, components of the washing machine, including a drum, a rotary shaft, and a driving motor, break down or have a shortened life span.

Particularly, a drum washing machine has a structure in which a drum accommodating laundry is disposed horizontally so that the drum is rotated at a high speed in a dehydrating (drying) operation under the condition that the laundry is gathered together on the bottom of the drum by gravity. Thus, the center of gravity of the drum does not coincide with the center of rotation of the drum. Therefore, the drum washing machine has a great possibility of generating vibration and noise.

Drum washing machines, in which a drum is disposed horizontally, and vertical axis washing machines, in which a drum is disposed vertically, are generally provided with balancers for maintaining the dynamic balance of the drum.

Korean Patent Laid-open Publication No. 10-1999-0038279 discloses an example of a washing machine having balancers. Each of the balancers of this washing machine includes a racer installed at the upper or lower part of a drum for maintaining the dynamic balance of the drum when the drum is rotated at a high speed. Balls made of steel and freely movably are disposed in the racer, and viscous oil fills the inside of the racer.

When the drum is rotated, the drum cannot maintain its dynamic balance due to the unbalanced eccentric structure of the drum and the partial distribution of laundry in the drum. Then, the steel balls compensate for the above unbalance, thus allowing the drum to maintain its dynamic balance.

Since the viscous oil of the balancer employed by the above conventional washing machine is sensitive to an outdoor temperature, in the case that a gap between the inner wall of the racer and the steel balls is small, the ball balancer has a considerably high deviation in vibration (time) to attain a correct position according to the outdoor temperature.

On the other hand, in the case that the gap between the inner wall of the racer and the steel balls is large, the ball balancer rapidly attains a correct position, and thus the vibration of the drum is decreased. However, in this case, when the viscosity of the viscous oil is low, the ball balancer generates a large amount of noise. Further, when the gap is expanded to a certain extent, it is difficult to control vibration and noise characteristics due to the manufacturing error of the racer.

SUMMARY

In an aspect of embodiments, there is provided a washing machine having ball balancers, which adjusts a relation between a gap between the inner wall of a racer of each of the ball balancers and balls, and the washing machine having viscous oil, thus reducing the of vibration and noise of the washing machine.

In another aspect of embodiments, there is provided a washing machine having at least one ball balancer, each of which comprises balls and viscous oil accommodated in a racer, wherein the viscosity of the viscous oil is varied in proportion to a gap between the racer and the balls.

In another aspect of embodiments, there is provided a washing machine having ball balancers, in which a dynamic balance of a drum is maintained using the ball balancers, each comprising balls and viscous oil accommodated in a racer, wherein the viscosity of the viscous oil is 100~380 cSt, and a gap between the racer and the balls is 1.0~1.0 mm.

In another aspect of embodiments, there is provided a washing machine having ball balancers, in which a dynamic balance of a drum is maintained using the ball balancers, each comprising balls and viscous oil accommodated in a racer, wherein the viscosity of the viscous oil is 1~100 cSt, and a gap between the racer and the balls is 0.5~1.0 mm.

In another aspect of embodiments, there is provided a washing machine having ball balancers, in which a dynamic balance of a drum is maintained using the ball balancers, each comprising balls and viscous oil accommodated in a racer, wherein the viscosity of the viscous oil is 380~1,000 cSt, and a gap between the racer and the balls is 2.0~3.0 mm.

In accordance with yet another aspect of embodiments, there is provided a balancer for installation in a drum washing machine having a rotating drum, wherein: the balancer includes a racer to be installed in the rotating drum, the racer including a viscous oil and a plurality of ball balancers movably installed in the racer, the balancer to maintain a dynamic balance of the rotating drum using the ball balancers to compensate for an imbalanced mass caused by laundry during rotation of the rotating drum, and the viscosity of the viscous oil is varied in proportion to a gap between the racer and the balls.

In accordance with yet another aspect of embodiments, the present invention provides there is provided a plurality of balancers for installation in a drum washing machine having a rotating drum, wherein: each balancer includes a racer to be installed in the rotating drum, the racer including a viscous oil and a plurality of ball balancers movably installed in the racer, the plurality of balancers maintain a dynamic balance of the rotating drum using the ball balancers to compensate for an imbalanced mass caused by laundry during rotation of the rotating drum, and the viscosity of the viscous oil is varied in proportion to a gap between the racer and the balls in each balancer.

BRIEF DESCRIPTION OF THE DRAWINGS

These and/or other aspects, features, and advantages of exemplary embodiments will become apparent and more readily appreciated from the following description of exemplary embodiments, taken in conjunction with the accompanying drawings in which.

DETAILED DESCRIPTION OF EMBODIMENTS

Figure 1:
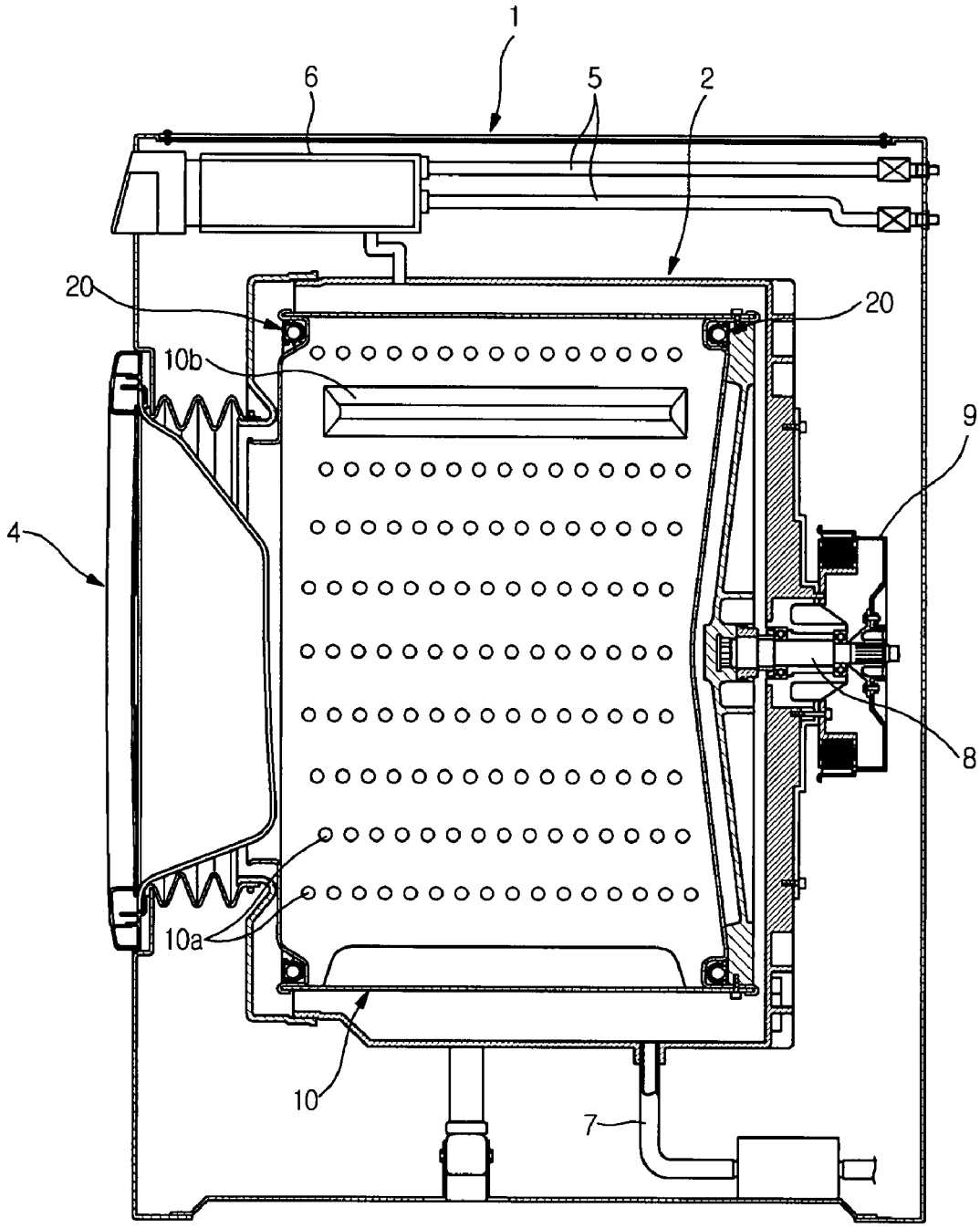
FIG. 1 is a schematic sectional view of a washing machine in accordance with an exemplary embodiment.

Reference will now be made in detail to exemplary embodiments, an example of which is illustrated in the accompanying drawings, wherein like reference numerals refer to like elements throughout. Exemplary embodiments are described below by referring to the annexed drawings.

FIG. 1 is a schematic sectional view of a drum washing machine in accordance with an exemplary embodiment. As shown in FIG. 1, the drum washing machine includes a housing 1 forming the external appearance of the washing machine, a tub 2 installed in the housing 1 for containing washing water, a drum 10 rotatably disposed in the tub 2 such that laundry is put into the drum to be washed, and a door 4 hinged to the opened front surface of the housing 1.

Water supply pipes 5 and a detergent supply device 6 for supplying washing water and a detergent to the tub 2 are disposed above the tub 2, and a drain pipe 7 for discharging the washing water contained in the tub 2 to the outside of the housing 1, when the washing of the laundry is completed, is disposed below the tub 2.

A rotary shaft 8 is extended through the rear surface of the tub 2 and is disposed on the rear surface of the drum 10, and a driving motor 9, to which the rotary shaft 8 is connected, is installed at the outside of the rear surface of the tub 2. Accordingly, when the driving motor 9 is operated, the rotary shaft 8 is rotated, and thus the drum 10 is rotated together with the rotation of the rotary shaft 8.

A plurality of dehydration holes 10*a* is formed through the circumferential surface of the drum 10. The dehydration holes 10*a* allow the washing water contained in the tub 2 to flow into the drum 10 so as to wash the laundry using the washing water, in which the detergent dissolves, in a washing operation, and allow the washing water to be discharged to the outside of the housing 1 through the drain pipe 7 in a dehydrating operation.

A plurality of lifters 10*b* is disposed in the drum 10 in the longitudinal direction. As the drum 10 is rotated at a low speed in the washing operation, the lifters 10*b* lift laundry, soaked in the washing water, from the bottom of the drum 10, and then drop the laundry to the bottom of the drum 10, thus allowing the laundry to be effectively washed.

Therefore, in the washing operation, the rotary shaft 8 is rotated alternately in regular and opposite directions using the driving motor 9 and the drum 10 is rotated at a low speed, thus washing the laundry. Further, in the dehydrating operation, the rotary shaft 8 is rotated in one direction and the drum 10 is rotated at a high speed, thus dehydrating the laundry.

When the drum 10 is rotated at the high speed in the dehydrating operation, the center of gravity of the drum 10 does not coincide with the center of rotation of the drum 10, or the laundry is not uniformly disposed in the drum 10 but is crowded at a specific region of the drum 10. Then, the drum 10 cannot maintain its dynamic balance.

In order to prevent the above dynamic unbalance of the drum 10 so that the drum 10 can be rotated at a high speed under the condition that the center of gravity of the drum 10 coincides with the center of rotation of the drum 10, ball balancers 20 are respectively installed at front and rear ends of the drum 10.

Figure 2:
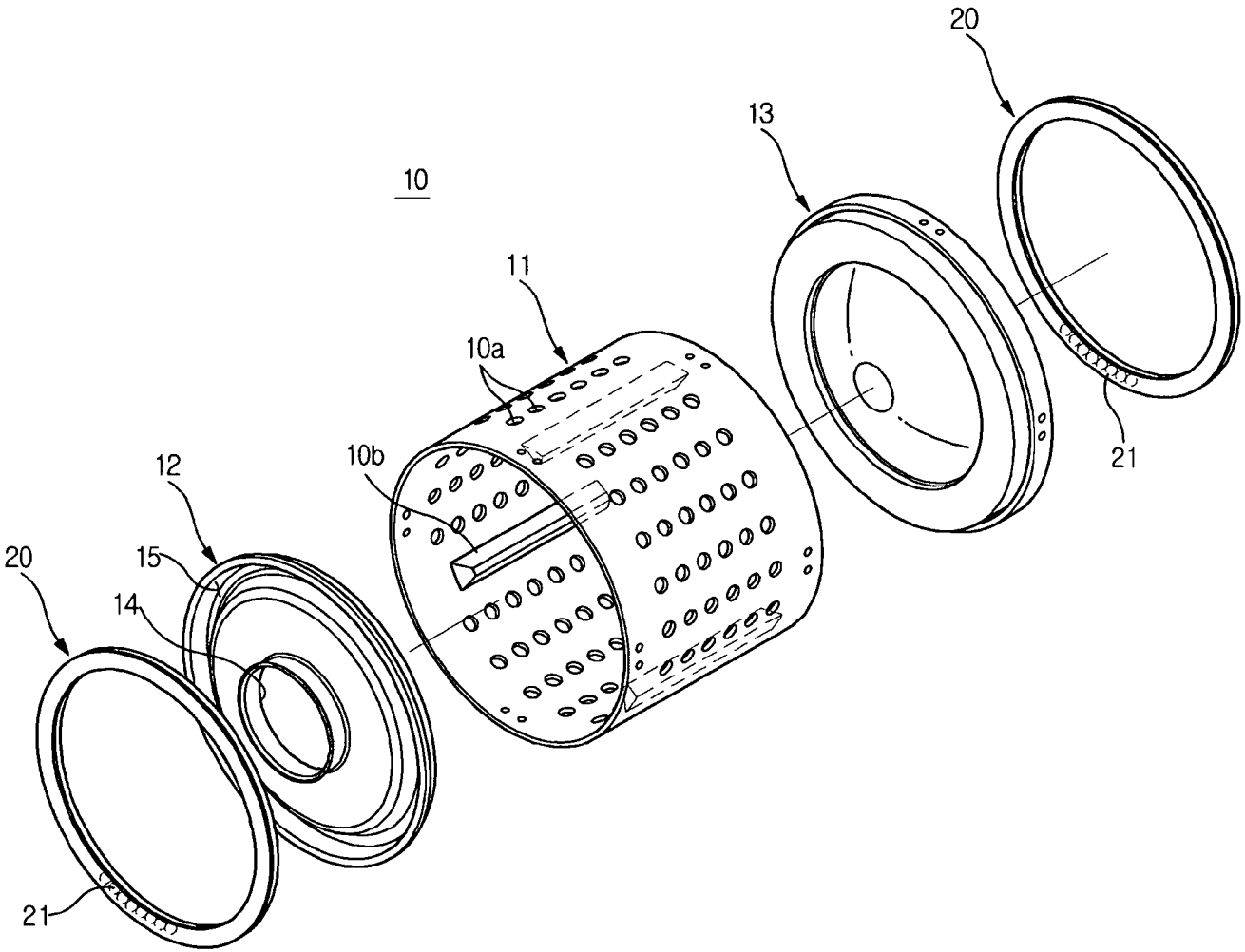
FIG. 2 is an exploded perspective view of a drum of the washing machine in accordance with an exemplary embodiment.
Figure 3:
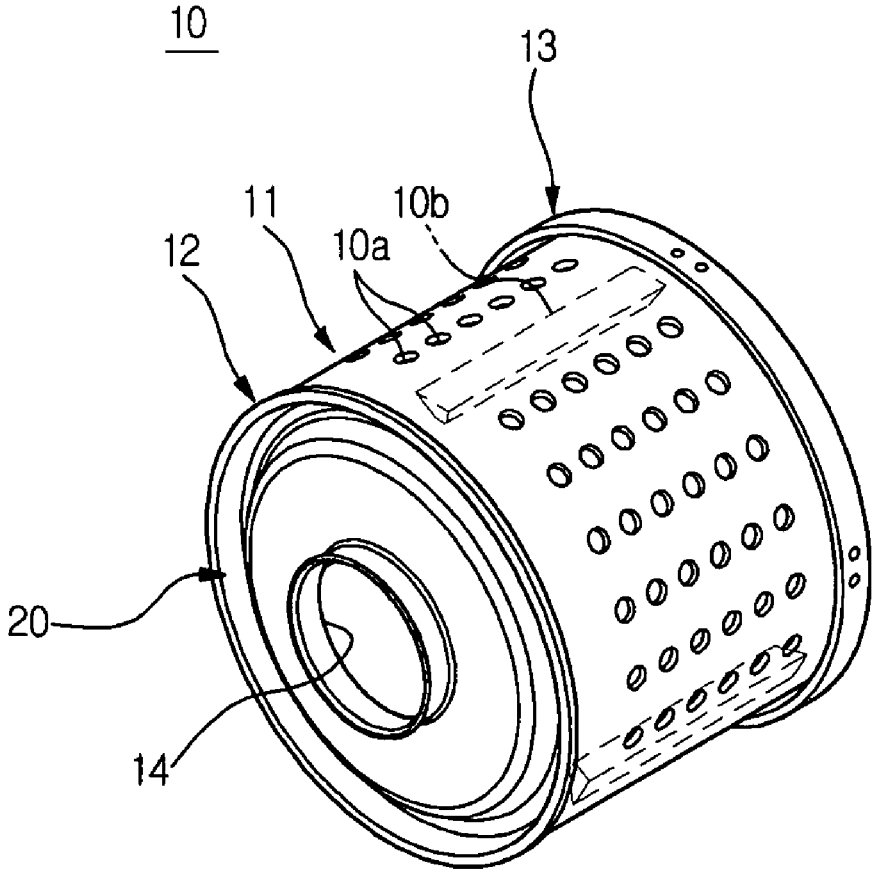
FIG. 3 is a perspective view of the drum of the washing machine in accordance with an exemplary embodiment in an assembled state.

FIG. 2 is an exploded perspective view of the drum of the washing machine of an exemplary embodiment, and FIG. 3 is a perspective view of the drum of the washing machine of an exemplary embodiment in an assembled state. As shown in FIGS. 2 and 3, the drum 10 includes a cylindrical main body 11 having opened front and rear end portions and provided with the dehydration holes 10*a* and the lifters 10*b*, a front member 12 connected to the opened front end portion of the main body 11 and provided with an opening 14 through which laundry is put into or taken out of the main body 11, and a rear member 13 to which the rotary shaft 8 (with reference to FIG. 1) for rotating the drum 10 is connected, wherein the rear member 13 is connected to the opened rear end portion of the main body 11.

A ring-shaped recess 15 having an approximately U-shaped section for accommodating the ball balancer 20 is formed in the edge of the front member 12, and a ring-shaped recess (not shown) having an approximately U-shaped section for accommodating the ball balancer 20 is formed in the edge of the rear member 13.

The front member 12 and the rear member 13, as shown in FIG. 3, are respectively inserted into the rims of the front and rear ends of the main body 11, and are connected to the main body 11 using screws or by other methods.

Figure 4:
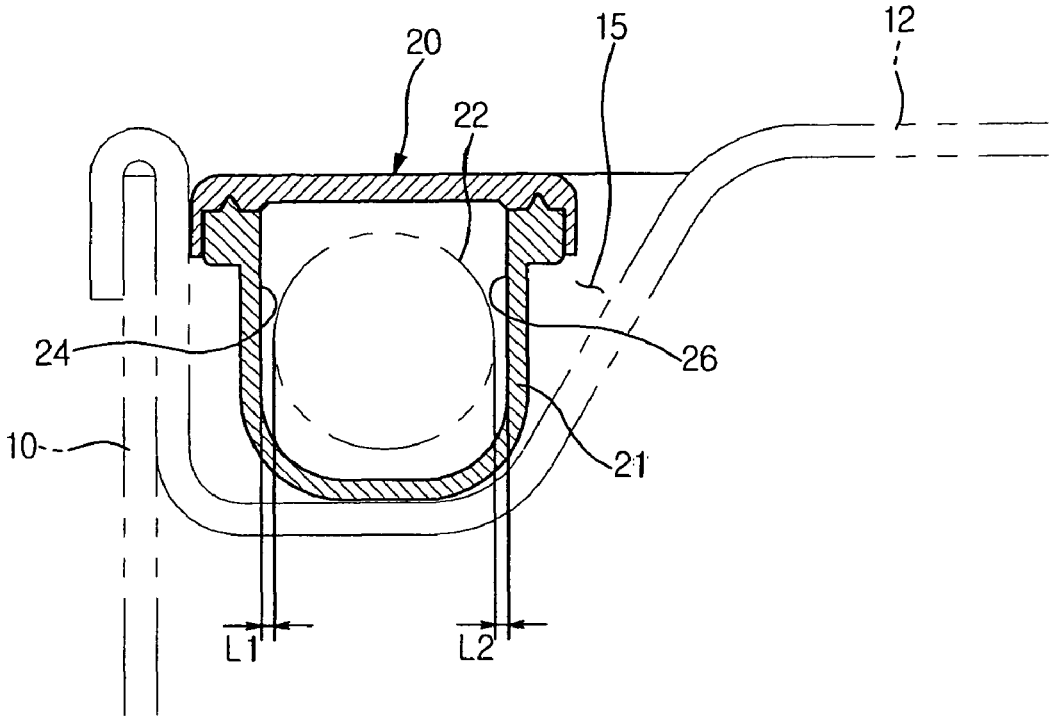
FIG. 4 is a view illustrating a ball balancer installed on the drum of the washing machine in accordance with an exemplary embodiment.

FIG. 4 illustrates the ball balancer installed on the drum of the washing machine of an exemplary embodiment. As shown in FIG. 4, the ball balancer 20 includes a ring-shaped racer 21 and forming a closed internal space by melting, a plurality of metal balls filling the internal space of the racer 21 to exhibit a balancing function, and viscous oil (not shown), which is a silicon-based synthetic lubricant, for adjusting the moving speed of the balls 22. Of course, the plurality of the balls 22 and the viscous oil fill the internal space of the racer 21 before both ends of the racer 21 are connected.

The above ring-shaped ball balancer 20 is disposed in each of the ring-shaped recesses 15 provided in the front and rear members 12 and 13 of the drum 10, and is welded to each of the ring-shaped recesses 15 at several points, thus being simply and rapidly assembled with the ring-shaped recesses 15.

In accordance with an exemplary embodiment, in order to operate the ball balancer 20 rapidly, a relation between a gap (L1+L2), between the first and second inner walls 24 and 26 of the racer 21 and the balls 22, and the viscous oil is very important. Preferably, the viscosity of the viscous oil is in proportion to the gap (L1+L2) between the racer 21 and the balls 22. For example, in the case that the gap is increased, the viscosity of the viscous oil should be high so as to exhibit excellent vibration and noise characteristics, and in the case that the gap is decreased, the viscosity of the viscous oil should be low so as to effectively move the balls 22 to maintain the dynamic balance of the drum 10 rapidly.

More specifically, FIGS. 5 to 10 are graphs respectively illustrating vibration and noise values according to the relation between a gap and viscous oil in ball balancers of washing machines in accordance with various exemplary embodiments.

Figure 5:
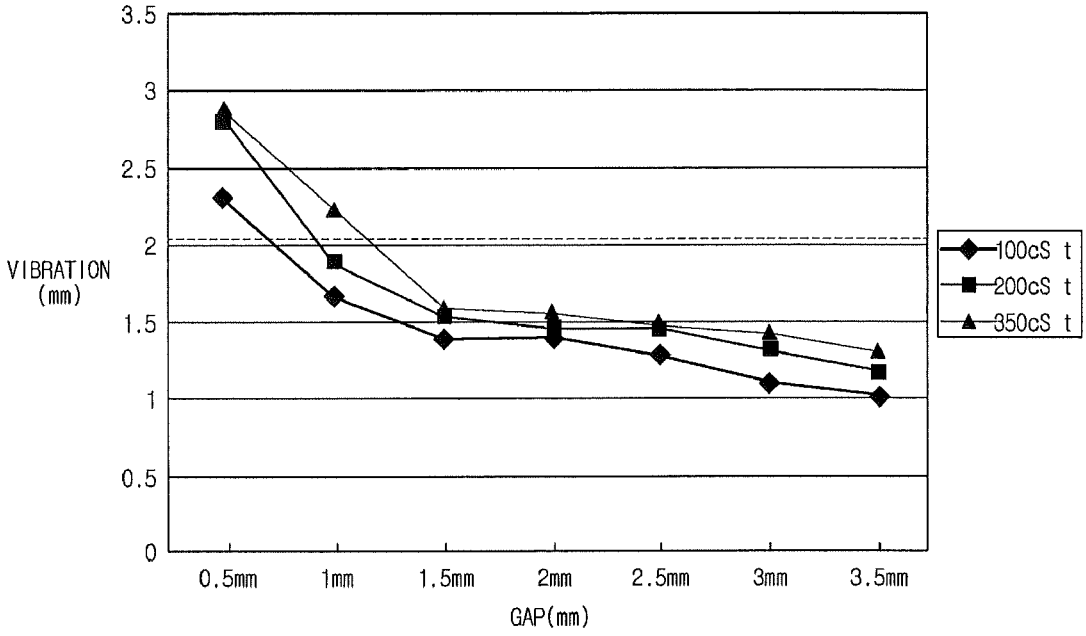
FIGS. 5 and 6 are graphs respectively illustrating vibration and noise values according to the relation between a gap and viscous oil in a ball balancer of a washing machine in accordance with an exemplary embodiment.
Figure 6:
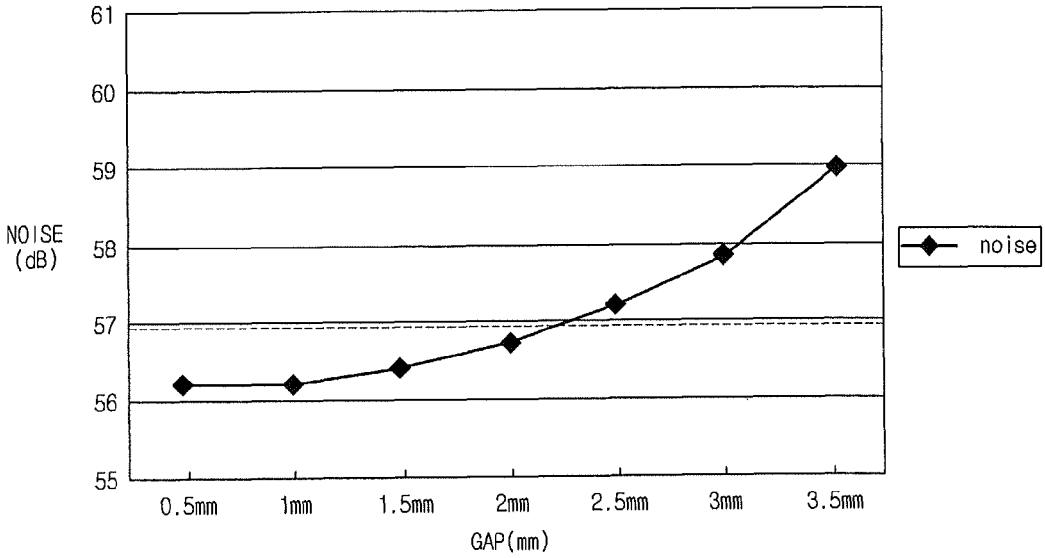

First, FIGS. 5 and 6 are graphs respectively illustrating vibration and noise values according to the relation between a gap and viscous oil in a ball balancer of a washing machine in accordance with one exemplary embodiment. FIGS. 5 and 6 illustrate results of a test, in which viscous oils having viscosities of 100, 200, and 350 cSt, being on the market at present, are used under the condition that the gap (L1+L2) varies. In the case that the ball balancer uses viscous oil having a viscosity of 100~380 cSt under the condition that the gap is less than 1 mm, the obtained vibration exceeded a value (the range of the vibration of the drum), which is usually required, i.e., 2 mm, and thus this ball balancer was improper. On the other hand, in the case that the ball balancer uses the viscous oil having a viscosity of 100~380 cSt under the condition that the gap is more than 2 mm, the obtained vibration satisfied the value but the obtained noise exceeded a value (the noise generated from balls), which is usually required, i.e., 57 dB, and thus this ball balancer was improper.

Figure 7:
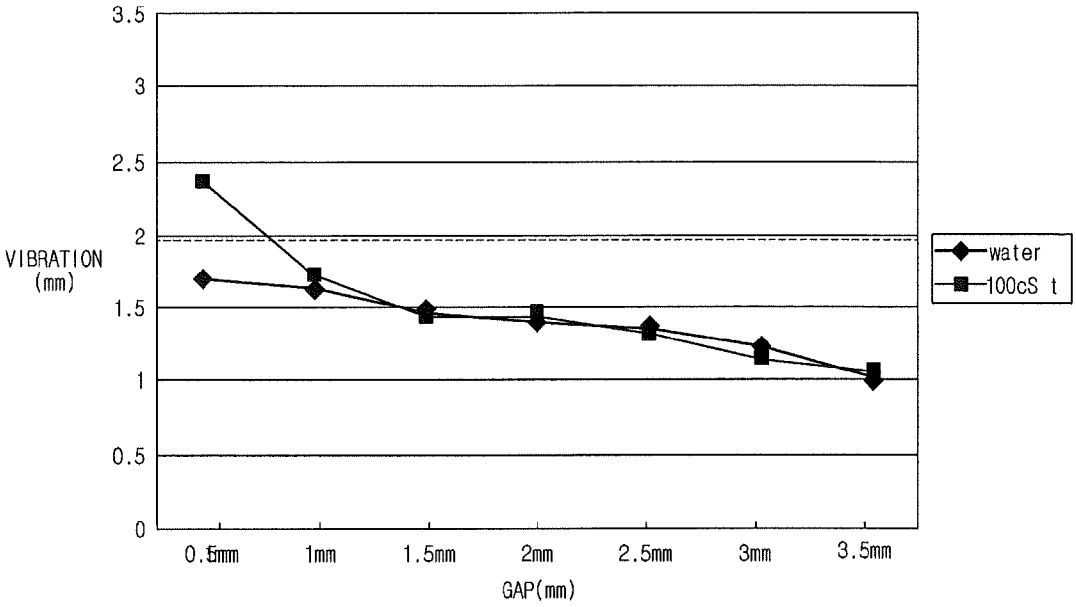
FIGS. 7 and 8 are graphs respectively illustrating vibration and noise values according to the relation between a gap and viscous oil in a ball balancer of a washing machine in accordance with another exemplary embodiment.
Figure 8:
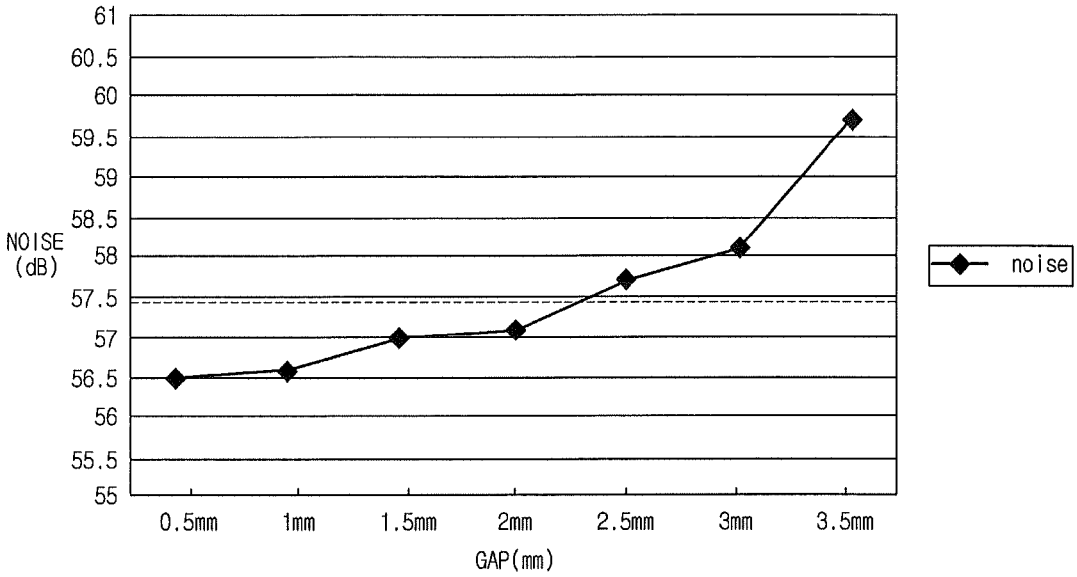

FIGS. 7 and 8 illustrate results of a test, in which viscous oil having a viscosity of 100 cSt is used under the condition that the gap (L1+L2) varies. In the case that the ball balancer uses viscous oil having a viscosity of 1~100 cSt under the condition that the gap is less than 0.5 mm, the obtained vibration exceeded the value (the range of the vibration of the drum), which is usually required, i.e., 2 mm, and thus this ball balancer was improper. On the other hand, in the case that the ball balancer uses the viscous oil having a viscosity of 1~100 cSt under the condition that the gap is more than 1 mm, the obtained vibration satisfied the value but the obtained noise exceeded the value (the noise generated from balls), which is usually required, i.e., 57 dB, and thus this ball balancer was improper.

Figure 9:
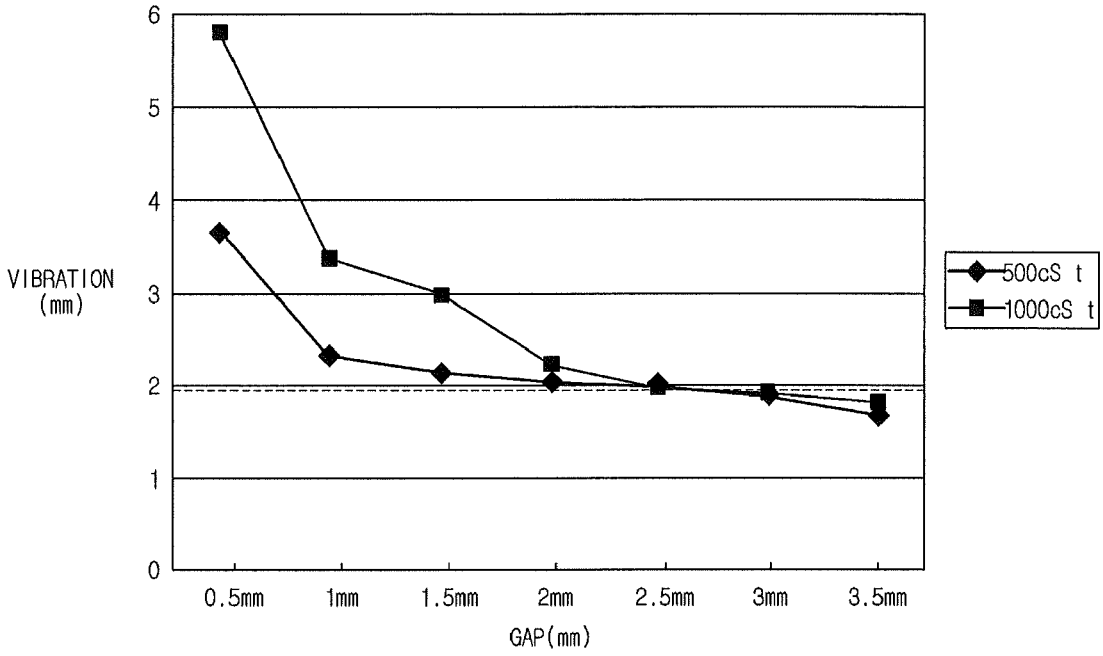
FIGS. 9 and 10 are graphs respectively illustrating vibration and noise values according to the relation between a gap and viscous oil in a ball balancer of a washing machine in accordance with yet another exemplary embodiment.
Figure 10:
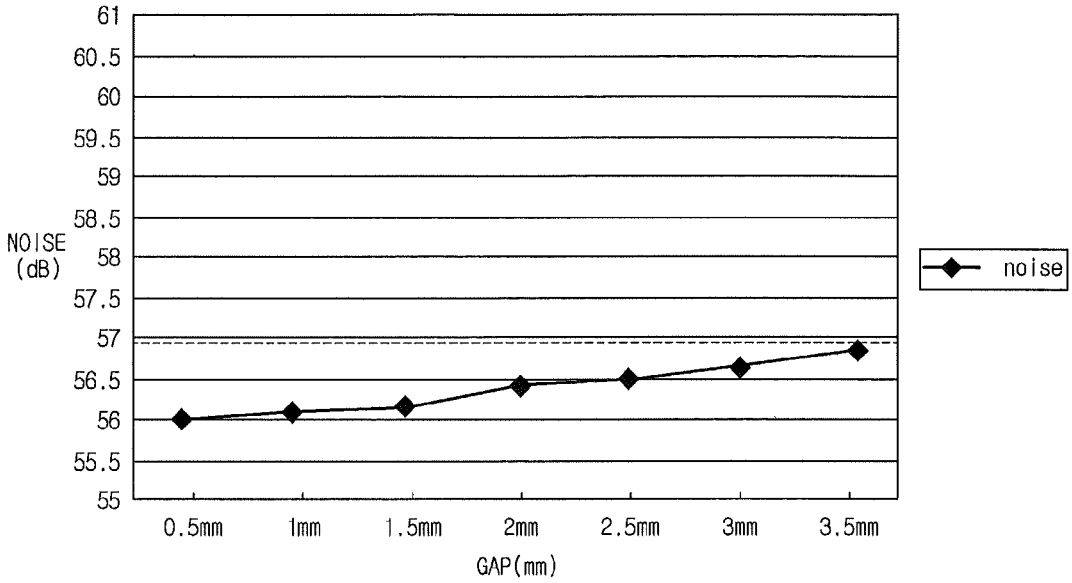

FIGS. 9 and 10 illustrate results of a test, in which viscous oils having viscosities 500 and 1,000 cSt are used under the condition that the gap (L1+L2) varies. In the case that the ball balancer uses viscous oil having a viscosity of 380~1,000 cSt under the condition that the gap is less than 2 mm, the obtained vibration exceeded the value (the range of the vibration of the drum), which is usually required, i.e., 2 mm, and thus this ball balancer was improper. On the other hand, in the case that the ball balancer uses the viscous oil having a viscosity of 380~1,000 cSt under the condition that the gap is more than 3 mm, the obtained vibration satisfied the value but the obtained noise exceeded the value (the noise generated from balls), which is usually required, i.e., 57 dB, and thus this ball balancer was improper.

In the case that the ball balancer uses viscous oil having a viscosity of 1,000 cSt or more, the gap may be more than 3 mm. However, when the gap exceeds 3 mm, the ball balancer cannot correctly control the vibration and noise values due to the piling upon of the balls each other and the tolerance between injection molded products for forming the racer 31. Further, in the case that the ball balancer uses viscous oil having a viscosity of 1 cSt, being close to water, the viscosity of the viscous oil cannot be uniformly controlled.

Consequently, when the viscosity of the viscous oil is 1~100 cSt, the gap is set to 0.5~1.0 mm, when the viscosity of the viscous oil is 100~380 cSt, the gap is set to 1.0~2.0 mm, and when the viscosity of the viscous oil is not more than 380~1,000 cSt, the gap is set to 2.0~3.0 mm. Thereby, the ball balancer effectively exhibits a balancing function.

As apparent from the above description, exemplary embodiments provide a washing machine having ball balancers, in which a relation between a gap between the inner wall of a racer of each of the ball balancers and the balls, and viscous oil is optimized, thus minimizing the vibration and noise of the washing machine.

Although a few exemplary embodiments have been shown and described, it would be appreciated by those skilled in the art that changes may be made in these exemplary embodiments, the scope of which is defined in the claims and their equivalents.

What is claimed is:

1. A washing machine comprising:

a housing;

a tub in the housing to contain washing water;

a drum rotatably disposed in the tub to receive laundry to be washed, the drum including a front cover with an opening provided at a front side of a drum body to receive laundry, an annular recess being formed in the front cover such that the annular recess is located immediately adjacent to a wall of the drum body; and a ball balancer coupled to the drum to compensate for a dynamic imbalance during rotation of the drum, the ball balancer including a ring-shaped racer constructed of injection molded pieces, the ring-shaped racer having a closed internal space in which a plurality of balls and viscous oil having a viscosity in a range of 100~380 cSt are accommodated, wherein a width between opposing side walls defining the closed internal space of the racer is greater than a diameter of the balls such that a gap (L1+L2) in a range of 1.0~2.0 mm is formed between each of the balls and the opposing side walls, and the ball balancer is supported by the annular recess formed in the front cover of the drum.

2. A washing machine comprising:

a housing;

a tub in the housing to contain washing water;

a drum rotatably disposed in the tub to receive laundry to be washed, the drum including a front cover with an opening provided at a front side of a drum body to receive laundry, an annular recess being formed in the front cover such that the annular recess is located immediately adjacent to a wall of the drum body; and a ball balancer coupled to the drum to compensate for a dynamic imbalance during rotation of the drum, the ball balancer including a ring-shaped racer constructed of injection molded pieces, the ring-shaped racer having a closed internal space in which a plurality of balls and viscous oil having a viscosity in a range of 1~100 cSt are accommodated, wherein a width between opposing side walls defining the closed internal space of the racer is greater than a diameter of the balls such that a gap (L1+L2) in a range of 0.5~1.0 mm is formed between each of the balls and the opposing side walls, and the ball balancer is supported by the annular recess formed in the front cover of the drum.

3. The washing machine according to claim 1, wherein the viscous oil includes a silicon-based synthetic lubricant.

4. The washing machine according to claim 1, wherein the ball balancer is accommodated in the annular recess such that the outer surface of the ball balancer is supported by the recess in a direction of centrifugal force.

5. The washing machine of claim 1, wherein the wall of the drum body and a part of the front cover forming the recess form double wall layers to reinforce the drum body.

6. The washing machine of claim 2, wherein the wall of the drum body and a part of the front cover forming the recess form double wall layers to reinforce the drum body.

* * * * *